US006340238B1

(12) United States Patent
Pan

(10) Patent No.: US 6,340,238 B1
(45) Date of Patent: Jan. 22, 2002

(54) HANGER STRUCTURE USED FOR DECORATIVE LIGHT BULB STRINGS

(76) Inventor: Wun Fang Pan, No. 123, Lane 99, Pu Din Road, Hsinchu City (TW)

( * ) Notice: Subject to any disclaimer, the term of this patent is extended or adjusted under 35 U.S.C. 154(b) by 0 days.

(21) Appl. No.: 09/612,447

(22) Filed: Jul. 7, 2000

(51) Int. Cl.[7] ..... F21V 21/36

(52) U.S. Cl. ..... 362/391; 362/249; 362/396; 439/575

(58) Field of Search ..... 362/249, 391, 362/396, 806; 439/574, 575

(56) References Cited

U.S. PATENT DOCUMENTS 1,861,151 A * 5/1932 Buschman ..... 248/229.6

1,895,656 A * 1/1933 Gadke ..... 439/575

* cited by examiner

*Primary Examiner*—Sandra O'Shea
*Assistant Examiner*—John Anthony Ward
(74) *Attorney, Agent, or Firm*—Rosenberg, Klein & Lee

(57) ABSTRACT

The disclosed in this invention is a hanger used for decorative light bulb strings. It primarily consists of a loop portion and a resilient retainer portion. A decorative light bulb string can be hung with ease by routing the electrical conductive wires thereof through the retainer portion of a hanger to form an arcuate light bulb array and further attached to other supporters by the loop portion of a hanger to display a unique decorative effect. In addition the hanger structure is also cost effective in manufacturing and thus it has economic value in industry.

1 Claim, 4 Drawing Sheets

HANGER STRUCTURE USED FOR DECORATIVE LIGHT BULB STRINGS

BACKGROUND OF THE INVENTION

Decorative light bulb strings are widely applied on various occasions. Using a variety of light bulb arrays to create a unique decorative effect is common in the practical field. As shown in FIGS. 1 through 3, a light bulb string is attached to a support by conventional hanging devices (1). Each hanging device (1) is composed of a hook portion (11), a barb portion (12), a catch portion (13) and a trough portion (14). The hanging device (1) can secure electrical conductive wires (2) in its trough portion (14) by locking the barb portion (12) with the catch portion (13) thereof. By routing electrical conductive wires through the trough portions of a plurality of hanging devices as shown in FIG. 1, a light bulb string can be attached to a support and displays a planar pattern. However, such an arrangement often needs a plurality of prior art hanging devices (1). Besides, the hanging mechanism is complicated in structure. It is not easy to disconnect the barb portion with the catch portion to release electrical conductive wires in the trough portion. Thus it does favor for repetitive use. Moreover, the hook portion of the device does not give a firm attachment to supports and thus dropping might happen. Once the light bulb string or the hanging device is broken, the replacement will be time-consuming.

In view of the above shortcomings, the object of the invention is to provide a hanger structure used for decorative light bulb strings that uses an ingenious design combined with a unique arrangement of light bulb strings to show an innovative decorative effect while it has practical and economical value in the field. Now the structure and features of this invention will be described in detail with reference to the accompanying drawings.

BRIEF DESCRIPTION OF ACCOMPANYING DRAWINGS

DETAILED DESCRIPTION OF THE INVENTION

Figure 1:
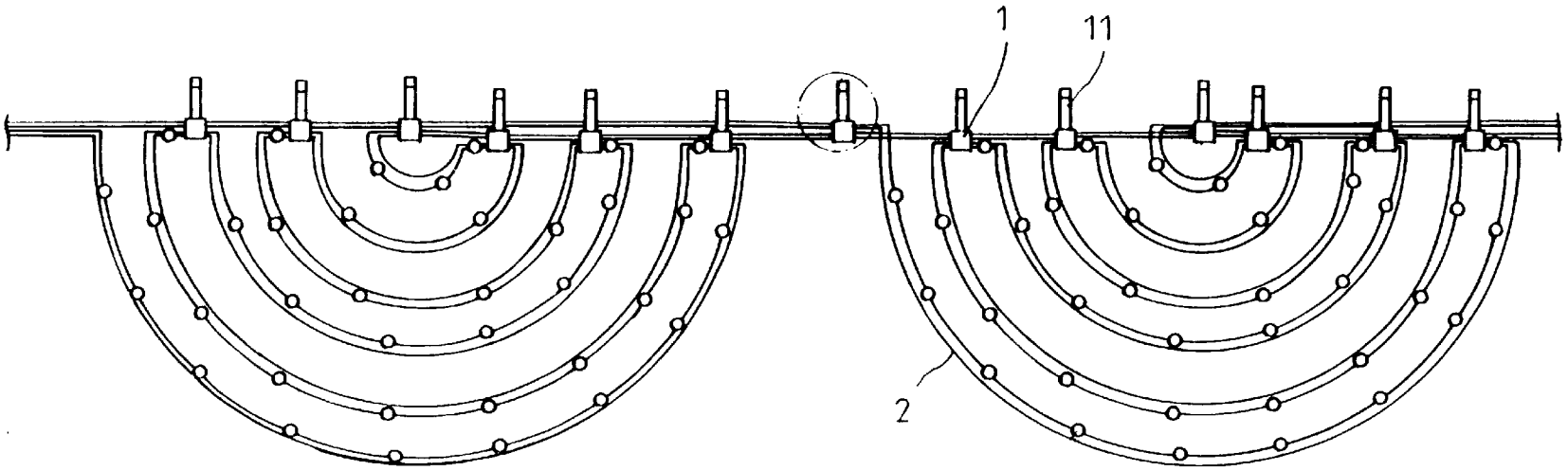
FIG. 1 (prior art)
FIG. 1 shows prior art hanging devices used for decorative light bulb strings.
Figure 2:
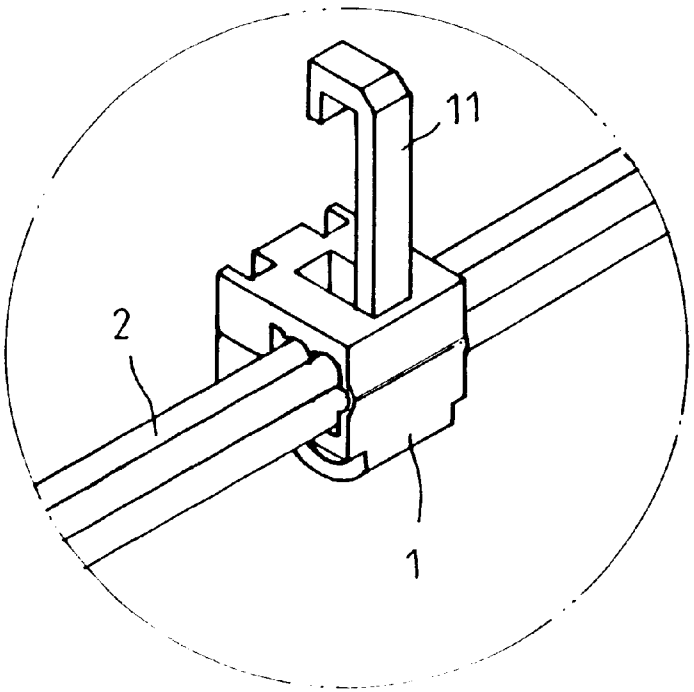
FIG. 2 (prior art)
FIG. 2 is a perspective view showing the prior art hanging device of FIG. 1.
Figure 3:
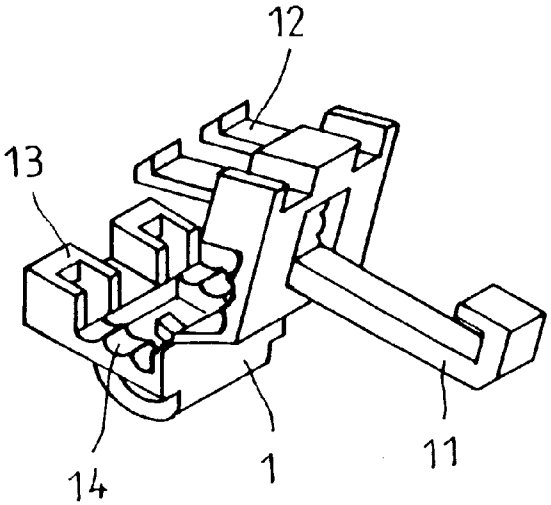
FIG. 3 (prior art)
FIG. 3 shows the prior art hanging device of FIG. 2 in a developed state.
Figure 4:
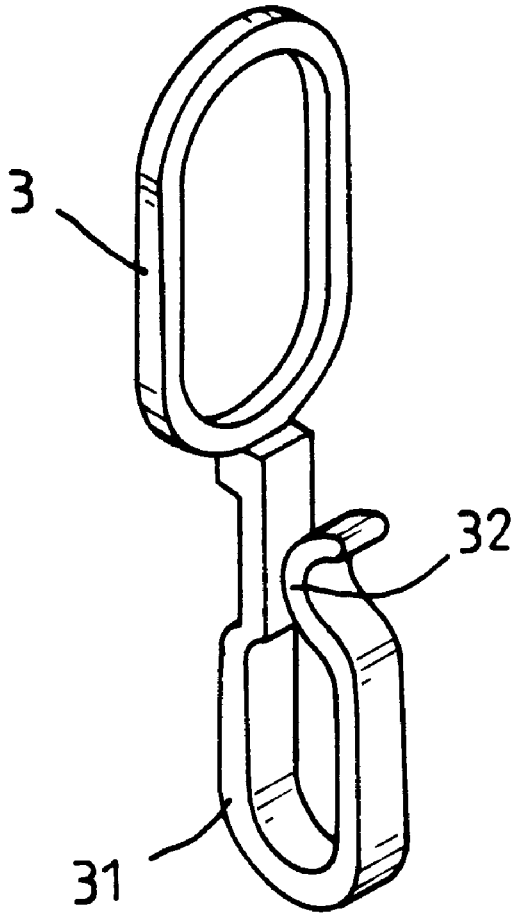
FIG. 4 is a perspective view showing a hanger according to the invention.
Figure 5:
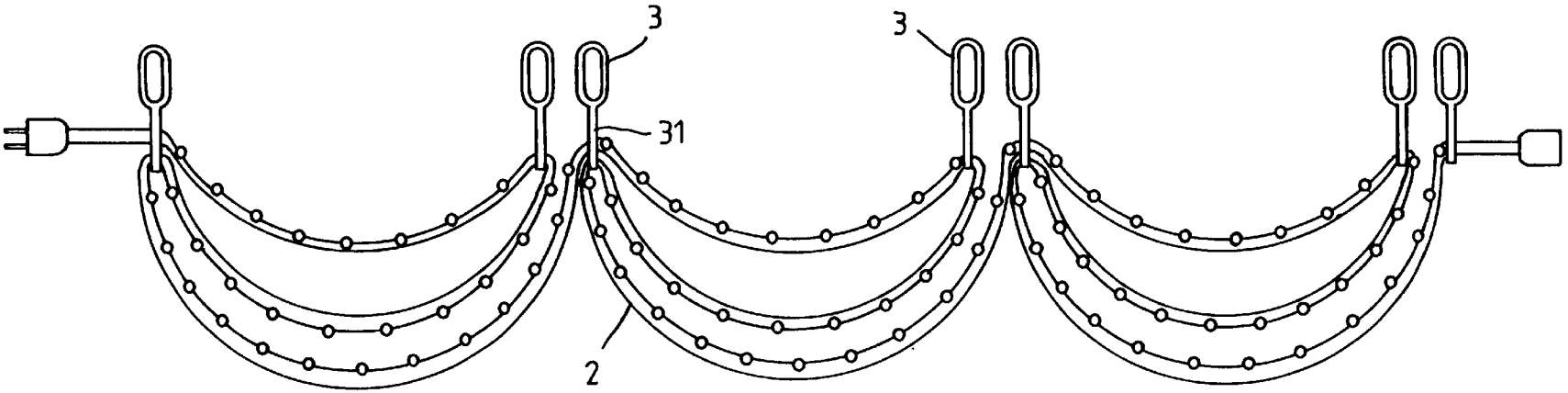
FIG. 5 illustrates the application of the hanger according to the invention.

Referring to FIGS. 4 and 5, the invention provides a hanger structure that comprises a ring-like loop portion (3) integrally molded with a resilient retainer portion (31). The resilient retainer portion (31) is provided with an opening (32) on the top as an entrance to the interior thereof. The entrance (32) has a curved configuration that facilitates the passage of electrical conductive wires. The entrance (32) is smaller in comparison with the diameter of an electrical conductive wire so that it only allows electrical conductive wires urged by an external force to pass through. The elasticity of material will restore the entrance to its original size after electrical conductive wires passing and so they can be secured inside. The interior of the retainer portion is dimensioned to accommodate two or more electrical conductive wires (2).

In application, the electrical conductive wires (2) of a light bulb string are routed through the retainer portion of a hanger (3) disposed on each turning point. These hangers are further attached to supports by their loop portion. In this way, a light bulb string can be arranged to form various patterns that are different from what conventional hanging devices can acquire. Furthermore, the hanger according to the invention provides convenience in use and is economical in cost. In addition, evidently the hanger of the invention is not only skillful in structure but also convenience in replacement. It meets the requirements of a patent grant.

What is claimed is:

1. A hanger for miniature light bulb strings comprising a longitudinally extended structure having a first loop portion formed on one end thereof and defining a vertically directed first planar envelope, and a second loop portion formed on an opposing end defining a vertically directed second planar envelope, said second planar envelope being substantially orthogonal to said first planar envelope, said first loop portion being formed by a closed ring for use in mounting to a support structure, said second loop being formed by a U-shaped resilient arm with a distal end having an arcuate portion spaced from said longitudinally extended structure to define an open upper end of said second loop, said arcuate portion being spaced from said longitudinally extended structure by a distance less than a diameter of an electrical conductive wire of a miniature light bulb string for removably capturing at least a pair of electrical conductive wires of the miniature light bulb string within said second loop.

* * * * *